United States Patent [19]

Gustairs

[11] 4,034,967

[45] July 12, 1977

[54] MIXER

[76] Inventor: John A. Gustairs, 11226 82nd Ave., N., Apt. 101, Seminole, Fla. 33542

[21] Appl. No.: 608,136

[22] Filed: Aug. 27, 1975

[51] Int. Cl.[2] ..... B01F 7/08

[52] U.S. Cl. ..... 259/6

[58] Field of Search ..... 259/104, 6, 21, 41, 259/75; 198/213, 214, 215

[56] References Cited

U.S. PATENT DOCUMENTS

| | | | |
|---|---|---|---|
| 966,455 | 8/1910 | Life | 259/104 |
| 3,064,908 | 11/1962 | Hjelte | 241/252 |
| 3,349,725 | 10/1967 | Bini | 259/6 |
| 3,817,496 | 6/1974 | Kratochvil | 259/6 |

*Primary Examiner*—Robert I. Smith

*Attorney, Agent, or Firm*—Reising, Ethington, Barnard, Perry and Brooks

[57] ABSTRACT

A mixer of the disclosure incorporates a unique rotor construction having an elongated shaft portion about which a mixing element is wound in an axially spiraling manner so as to define radial mixing lobes. The mixer includes a housing defining a mixing chamber that receives at least two of the rotors whose mixing elements are wound in the same direction with the same pitch and are arranged in a meshing relationship with each other. A gear unit of the mixer drives the rotors in the same direction at the same speed about their elongated shaft portions so the radial lobes of each rotor pass between those of the other to provide a mixing action to components received within the mixing chamber. The rotors are preferably detachably secured to the gear unit so as to be removable for cleaning. The flow of the components being mixed through the chamber is provided by supply line pressure and the rotors provide a screw action that creates a back-flow turbulence acting against this flow to aid in the mixing.

8 Claims, 5 Drawing Figures

MIXER

BACKGROUND OF THE INVENTION

1. Field of the Invention

The present invention relates to a mixer and to mixing rotors of the mixer which have a unique construction.

2. Description of the Prior Art

The prior art discloses many forms of mixers for mixing separate components into a homogeneous mixture. See, for example, the following U.S. Pat. Nos.: Bulley, 1,260,320; Pease, 2,048,286; Consalvo, 2,508,495; Colombo, 2,550,226; Simpson, 2,571,300; Kraffe De Laubarede, 2,631,016; Bridges, 2,947,524; and Hjelte, 3,064,908. Certain of the above patents disclose mixers including at least two mixing rotors that have spiraling screw configurations arranged in a meshing relationship with each other.

The rotors of a mixer must cause sufficient turbulent flow of the constituent components so they are thoroughly mixed with each other. The rotors must be relatively strong so that they can withstand the load to which they are subjected when mixing relatively viscous components. Such is the case when paints or the like are mixed for industrial use. Also, organic resin foams likewise are relatively viscous when mixed from their constituent components and must be thoroughly mixed before the foam begins to cure. Thus, the rotors must be driven fast enough so as to mix these foams prior to curing and must have sufficient strength to cause turbulent flow of the relatively viscous foam components.

Industrial mixers have not been completely satisfactory to date. The mixers either churn the components being mixed or cause them to remain stratified within the mixing chamber. Thus, a continuous mixing operation in a steady state manner with thorough mixing has not heretofore been achieved.

SUMMARY OF THE INVENTION

The present invention is directed to a mixer and to rotors of the mixer that have a unique construction for mixing constituent components into a homogeneous mixture. The mixer includes a housing defining a mixing chamber and also includes at least two of the rotors which are rotatably mounted by the housing and received within the mixing chamber. Each of the rotors includes an elongated shaft portion and a mixing element that is wound about the shaft portion in an axially spiraling manner so as to define radial lobes. The elements of each rotor are wound in the same direction with the same pitch and are arranged in a meshing relationship with each other. The rotors are driven in the same direction at the same speed about their elongated shaft portions so the mixing elements thereof mesh with the radial lobes of each rotor passing between those of the other to provide the turbulent flow required to mix the components received within the mixing chamber into a homogeneous mixture.

The mixer includes a gear unit for driving the rotors in a coordinated manner with each other. The gear unit includes a first gear that is driven by a motor as well as second and third gears respectively coupled to the rotors and driven by the first gear so as to provide the coordinated rotor rotation. The second and third gears are coupled to drive shafts of the gear unit to which the shaft portion of each rotor is preferably detachably secured. This detachable securement allows the rotors to be removed from the mixer for cleaning. The shaft portion of each rotor preferably is embodied as a sleeve that receives the associated drive shaft of the gear unit so as to provide the detachable rotor securement.

The housing of the mixer preferably has an oblong cross-section taken across the direction of rotor rotation and includes pointed members between the rotors that cooperate with the housing to define mixing chamber portions for each rotor. The mixer housing includes inlets through which the components to be mixed are introduced into the mixing chamber as well as an outlet through which the homogeneous mixture is discharged. The inlets are preferably spaced on opposite sides of the mixing chamber at one end of the housing. The outlet is positioned adjacent the axial ends of the rotors at the other end of the housing. Supply line pressure moves the components from the inlets toward the outlet. The direction of rotor rotation causes a screw action that tends to move the components being mixed against the supply line pressure away from the outlet towards the inlets. This screw action thus creates a back-flow turbulence that aids in the mixing action.

The spiraling element of each rotor preferably has a rectangular cross-section as it spirals so its radial lobes create turbulent flow during the mixing action. At their radial inner ends, the lobes are secured to the rotor shaft portion so the lobes have the required structural strength even when mixing relatively viscous components. The radial lobes are arranged in axially aligned sets. Preferably, there are three such sets on each rotor so there are enough lobes to provide thorough mixing without requiring the mixing elements to be bent too abruptly in defining the lobes.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
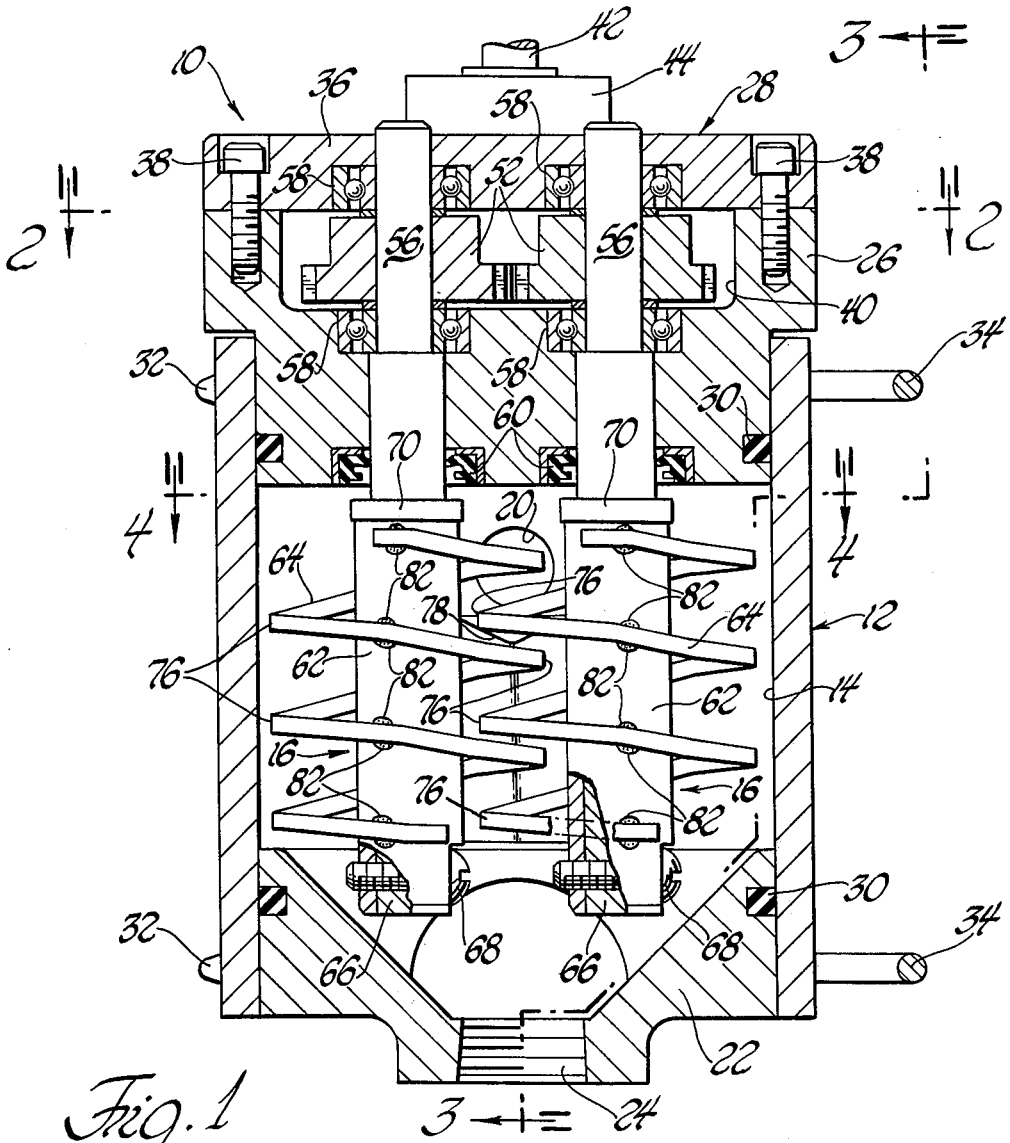
FIG. 1 is an elevation view in section of a mixer embodying the present invention.

Referring to FIG. 1 of the drawings, a mixer embodying the present invention is generally indicated by reference numeral 10 and includes a housing 12 defining a mixing chamber 14 in which components to be mixed are received. The mixer includes a pair of rotors 16 rotatably mounted by the housing and received within the mixing chamber 14. These rotors have a unique construction for mixing components within the mixing chamber.

The mixer housing 12 includes a pair of inlets 18 and 20 to the mixing chamber 14. The inlets are spaced on opposite sides of the rotors 16 at the upper end of the housing and are threaded so as to be attachable to pressurized supply lines for supplying components to be mixed. Although only two inlets are shown, three, four or any number of the inlets corresponding to the number of components to be mixed can be provided. The supply line pressure forces the components downwardly through the mixing chamber 14 so that the rotors 16 can mix them into a homogeneous mixture, as will be more fully hereinafter described. At the lower end of the housing 12, a closure member 22 closes the lower end of the mixing chamber 14 and defines a threaded outlet 24 for attaching a delivery line through which the homogeneous mixture is discharged at the axial ends of rotors 16. The upper end of the mixer housing 12 also includes a closure member 26 closing the upper end of the mixing chamber 14. This closure member 26 includes a gear unit 28 that supports and drives the mixing rotors 16 within the mixing chamber. Closure members 22 and 26 preferably include suitable seals 30, FIG. 1, and are retained in position by legs 32 of U-shaped retainers 34, FIG. 2.

Figure 2:
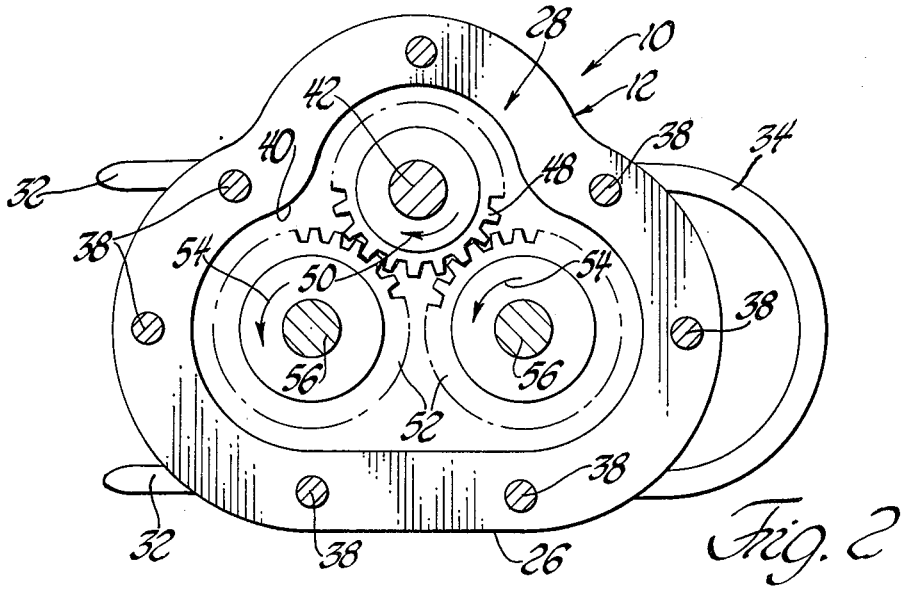
FIG. 2 is a top plan view taken in section through a gear unit of the mixer along line 2—2 of FIG. 1.

The gear unit 28 of the mixer includes a cap 36, FIG. 1, secured to the closure member 26 on the upper end of the housing by a plurality of recessed bolts 38. The cap is situated above an upwardly opening recess 40 in the upper closure member. An input shaft 42 of the gear unit is supported by a suitable bearing 44 on the upper side of the cap 36 and is driven by a suitable air or variable speed electric motor 46, FIG. 3. This input shaft extends downwardly into the recess 40, as shown in FIG. 2, and supports and is keyed to a gear 48 that is driven in the clockwise direction as shown by arrow 50. Gear 48 meshes with a pair of gears 52 which are thus driven in the counterclockwise direction shown by arrows 54. A pair of shafts 56 are keyed to the gear 52 so as to be driven by these gears and each is mounted by a pair of upper and lower antifriction bearing 58 as shown in FIG. 1. The lower antifriction bearing 58 of each shaft 56 is mounted by the closure member 26 just below the associated gear 52 while the upper bearing is mounted by the cap 36 just above its associated gear. The shafts 56 extend downwardly through annular seals 60 into the mixing chamber so as to drive the rotors 16.

Figure 3:
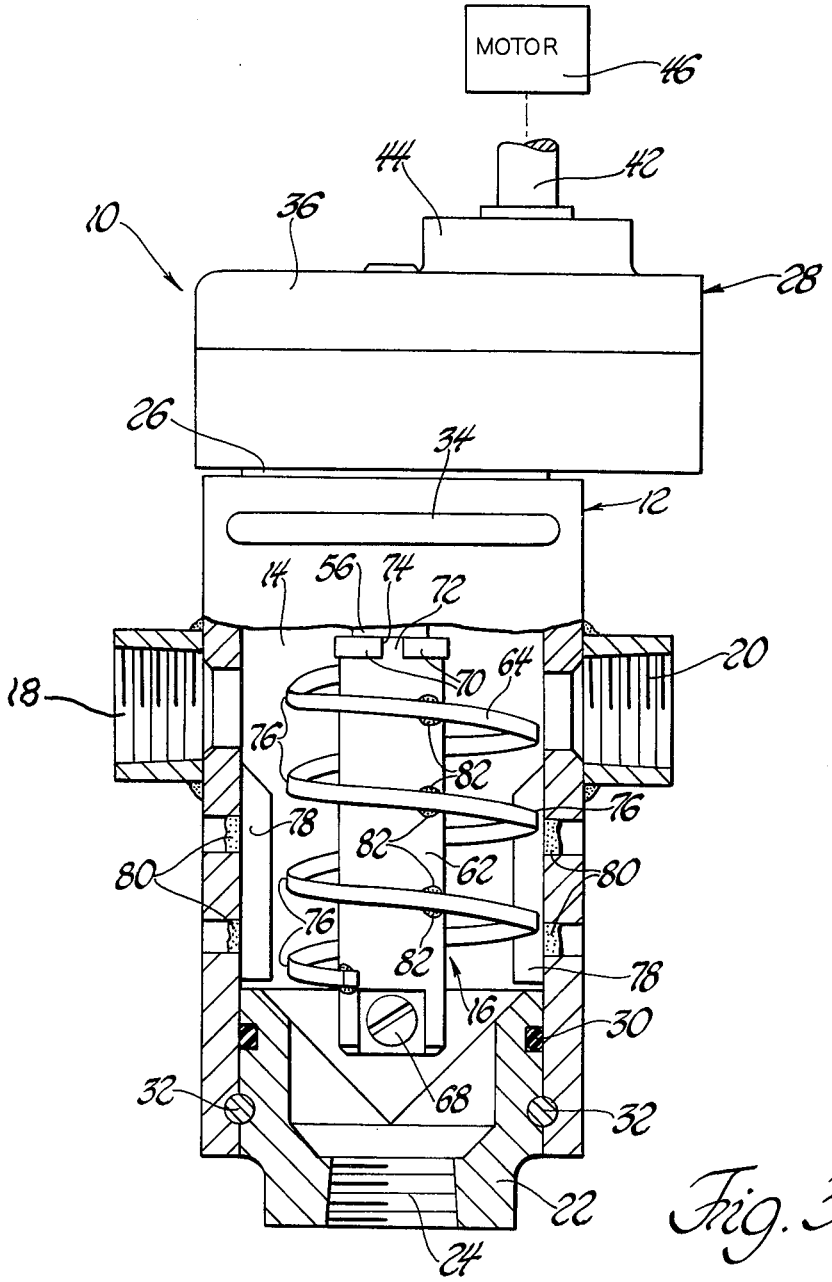
FIG. 3 is an elevation view taken partially in section along line 3—3 of FIG. 1.
Figure 4:
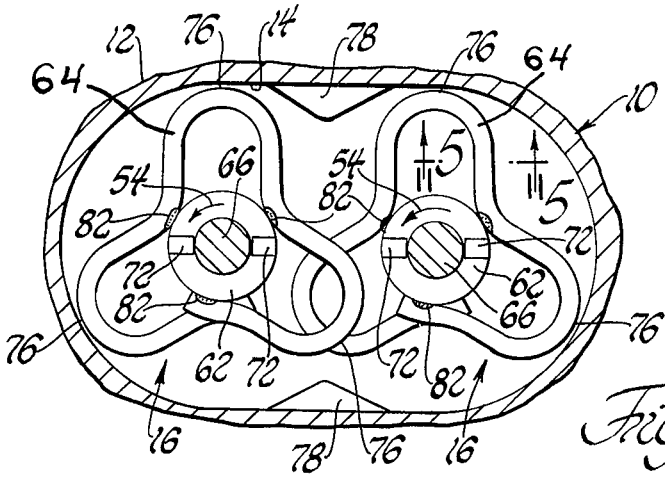
FIG. 4 is a plan view in section of the mixer taken along line 4—4 of FIG. 1.

As seen in FIG. 1, each of the rotors 16 includes an elongated shaft portion or sleeve 62 as well as a mixing element 64 that is wound about its associated sleeve. The rotor sleeves 62 are received on associated lower end portions 66 of the gear unit drive shafts 56 and are rotatably secured thereto in a detachable manner by screws 68. This detachable securement allows the rotors to be removed for periodic cleaning during use or upon completion of a mixing operation. The upper end of each sleeve 62 is abutted with a flange 70 on its associated drive shaft 56. As seen in FIGS. 3 and 4, the upper end of each mixing sleeve 62 includes lugs 72 that are spaced in a diametrically opposed relationship and extend upwardly to be received within associated opening 74 in the shaft flange 70. The lugs 72 thus cooperate with the screws 68 in establishing the rotary driving relationship of the rotors on the drive shafts 56.

The mixing elements 64 of each rotor is wound about its associated sleeve 62 in an axially spiraling manner and, as seen in FIG. 4, defines radial lobes 76 extending outwardly from the sleeve. The mixing elements 64 of each rotor are wound in the same direction with the same pitch and are arranged in a meshing relationship with each other. The gear unit 28 of the mixer drives the rotors 16 at the same speed in the counterclockwise direction shown by arrows 54 of FIG. 4 so that the mixing elements of the pair of rotors mesh with each other as the radial lobes of each one pass between those of the other to provide the mixing of components received within the mixing chamber into a homogeneous mixture.

Figure 5:
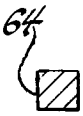
FIG. 5 is a sectional view through a spiraling mixing element of one rotor of the mixer and is taken along line 5—5 of FIG. 4.

The meshing radial lobes 76 of the rotors 16 provide good mixing action to the components which are fed downwardly through the mixing chamber 14 by virtue of the component supply line pressure through the inlets 18 and 20 downwardly toward the outlet 24. The direction of rotor rotation and the direction in which the mixing elements 64 are wound causes a screw action that tends to move the components being mixed upwardly toward the inlets away from the outlet. This screw action causes a backflow turbulence that aids in the mixing action. The mixing elements 64 preferably have a rectangular cross-section, which most preferably is square, as they spiral about their associated sleeves 62, see FIG. 5, so that the radial lobes 76 of each rotor provide a turbulent mixing action as they pass between the radial lobes of the other rotor.

The radial lobes 76 of each mixing element are arranged in axially aligned sets. The axial alignment of the lobes in each set permits closely spaced meshing of the mixing elements without engagement to give good mixing. While any number of the sets of radial lobes could be utilized on each rotor, three is the preferred number since this gives a sufficient number of lobes to provide good mixing without requiring abrupt bends in the mixing elements 64, as would be the case if more sets of lobes were used. Likewise, while three radial lobes 76 are shown in each set, any number may be used to give the required mixing action.

As seen in FIG. 4, the mixer housing 12 has an oblong cross-section so the radial lobes 76 sweep through the whole mixing chamber without any stagnant areas where unmixed components can come to rest. In this connection, the mixer housing 12 includes a pair of pointed members 78 that are secured within the mixing chamber 14 by welds 80, FIG. 3. These pointed members are located between the rotors 16 occupying the space where the rotor mixing lobes are unable to reach. The mixing chamber 14 is thus divided into portions associated with each rotor and each component within the mixing chamber is insured of being mixed with the other ones so that a homogeneous mixture is present upon being discharged through the lower outlet 24. The spacing between the drive shaft end portions 66 is preferably just large enough to permit the radial lobes 76 of each rotor to pass between those of the other without engaging its sleeve 62 but sufficiently close to the sleeve to permit thorough mixing action.

To give the rotor lobes 76 the required structural strength to mix relatively viscous components, the mixing elements 64 are secured, such as by welds 82, to the rotor sleeves 62 at the radial inner ends of the lobes. Thus, these lobes have the required structural strength to mix even highly viscous components into a homogeneous mixture.

It should be noted that reverse rotation of rotors 16 may be used to drive the components being mixed toward the outlet 24. This rotation causes the screw action of rotors 16, as they rotate clockwise as in FIG. 4, to move the components in the opposite direction to the back-flow turbulence previously mentioned. The mixer is purged by this reverse rotation between mixing operations or during down-time.

While a preferred embodiment of the mixer has been described in detail, those skilled in the art will recognize various alternative constructions and designs as set forth by the following claims.

What is claimed is:

1. A mixer comprising: a housing defining a mixing chamber for receiving components to be mixed; at least two rotors rotatably mounted by the housing within the mixing chamber; each of said rotors including an elongated shaft portion and a mixing element that is wound about the shaft portion in an axially spiraling manner so as to define radial lobes; said mixing elements being spaced from the associated shaft portions at the radial lobes so that the components being mixed can pass therethrough; the elements of the rotors being wound in the same direction with the same pitch and being arranged in a meshing relationship with each other; the lobes of the mixing elements having inner ends secured to the associated shaft portions and curved shapes extending radially between the inner ends thereof; each mixing element being secured to the associated shaft portion at the inner ends of the radial lobes for at least three times for each revolution thereabout; and drive means for rotating the rotors in the same direction at the same speed about their elongated shaft portions so the rotor elements thereof mesh with the radial lobes of each passing between those of the other to provide the mixing of components received within the mixing chamber into a homogeneous mixture.

2. A mixer according to claim 1 further including means for detachably securing the shaft portion of each rotor to the drive means to permit removal of the rotors for cleaning.

3. A mixer according to claim 2 wherein the detachable shaft portion of each rotor comprises a sleeve, and the drive means including at least two shafts for respectively receiving the sleeves of the rotors.

4. A mixer according to claim 1 wherein the housing defines an outlet through which the mixture is discharged and at least two inlets through which the components to be mixed are introduced into the mixing chamber.

5. A mixer according to claim 4 wherein the drive means rotates the rotors in a direction such that the spiraling orientation of the radial lobes moves the components being mixed away from the outlet toward the inlets and thereby creates a back-flow turbulence that aids in mixing the components.

6. A mixer according to claim 1 wherein the housing has an oblong cross-section taken across the direction of rotor rotation and includes pointed members between the rotors which cooperate with the housing to define mixing chamber portions for each rotor.

7. A mixer according to claim 1 wherein the drive means includes a motor as well as a gear unit driven by the motor and rotatably coupled to each rotor.

8. A mixer according to claim 7 wherein the gear unit includes a first gear driven by the motor and second and third gears respectively coupled to the rotors and driven by the first gear to coordinate the rotation of each rotor with the other.

* * * * *